United States Patent [19]

Kamei

[11] 4,222,189

[45] Sep. 16, 1980

[54] MEDALLION

[76] Inventor: Tomiro Kamei, No. 25, 3-Chome, Himegaike-Dori, Chigusa-ku, Nagoya City, Aichi Prefecture, Japan

[21] Appl. No.: 940,314

[22] Filed: Sep. 7, 1978

[51] Int. Cl.[3] ..... G09F 19/16

[52] U.S. Cl. ..... 40/160; 4/219

[58] Field of Search ..... 40/160, 616, 1.5, 124.5, 40/219, 152, 582; D11/101

[56] References Cited

U.S. PATENT DOCUMENTS

| | | | |
|---|---|---|---|
| 390,473 | 10/1888 | Green | 40/152 |
| 766,838 | 8/1904 | Neal | 40/124.5 |
| 1,718,333 | 6/1929 | Coria | 40/160 X |
| 2,071,240 | 2/1937 | Spencer et al. | 40/616 X |
| 2,468,731 | 5/1949 | Borkland | 40/160 UX |

FOREIGN PATENT DOCUMENTS

| | | | |
|---|---|---|---|
| 517502 | 10/1955 | Canada | 40/616 |
| 1235522 | 5/1960 | France | 40/160 |
| 1009550 | 11/1965 | United Kingdom | 40/160 |
| 1028012 | 5/1966 | United Kingdom | 40/160 |

*Primary Examiner*—John F. Pitrelli
*Assistant Examiner*—G. Lee Skillington
*Attorney, Agent, or Firm*—Fred Philpitt

[57] ABSTRACT

A medallion is composed of a front mirror surface portion, back surface portion and bottom surface portion, and a wreath type decoration portion such as olive leaves is formed in projected mode at the peripheral edge of the medallion, and a wall thickness of the mirror surface portion wherein a pattern such as face image or bust image of human being is formed by embossing or carving in the space surrounded by the decoration portion and the back surface portion formed almost perpendicularly to the mirror surface portion is so formed that the thickness is gradually heavier from the top part toward the bottom part, and a seat portion having a horizontal surface whose width is about 30–40% of the maximum width of the front surface portion of the medallion is formed at the bottom surface portion, and the mirror surface portion is formed in slightly inclined surface toward the rear part.

1 Claim, 3 Drawing Figures

MEDALLION

BACKGROUND OF THE INVENTION

The present invention relates to a medallion, and more particularly to a medallion that can be set so that the medallion itself becomes like an ornament for an alcove or an desk top, and the face image or bust image of a human being formed by embossing or carving on the mirror surface presents a pleasant sight to an observer when it is set on the alcove or the desk top.

Heretofore, medallions have been produced for memorializing a certain events or remembering the deceased, and the medallions are cast or injection molded by using copper, lead, gold or silver, etc. to emboss the pattern of the face image or bust image of a human being, so that they can be stored and preserved with a sense of treasure along with a sense of honor. These medallions are so formed that they are stored or used as a necklace by using a chain or cord. Therefore, in case these medallions are exhibited on a desk or display shelves, it is a common practice to exhibit the medallion in the stored condition in a vanity case, and it is not possible to display it like an ornament for the alcove or on the desk or the display shelves by removing from it the vanity case and by setting it thereon.

SUMMARY OF THE INVENTION

An object of the present invention is to provide a medallion wherein a horizontal seat portion is formed on the bottom surface portion, and as a result, the medallion can be vertically set directly on the desk or the display shelves like the ornament for the alcove after removing it from the vanity case whereby the medallion can be exhibited.

Also, another object of the present invention is to provide a medallion so that a wreath type decoration portion such as olive leaves are formed in projected mode at the peripheral edge of the medallion, and a pattern such as a face or bust image of a human being is formed by embossing or carving in the space surrounded by the decoration portion.

A further object of the present invention is to provide a medallion which is placed upright directly on the desk top or the display shelves, and the mirror surface is inclined slightly toward the rear part to allow a viewer to set the face image or bust image provided on the mirror surface in a satisfactory viewing position.

A still further object of the present invention is to provide a medallion that can be extremely easily fixed on a tombstone by employing a conventional installing means such as a bonding agent or pressure fitting at a depressed portion of the surface of the tombstone.

DETAILED DESCRIPTION OF THE INVENTION

The medallion generally indicated by letter M is so formed that the mirror surface portion 1 of the front surface is slightly inclined, and the back surface portion 2 is an almost perpendicular surface.

Figure 3:
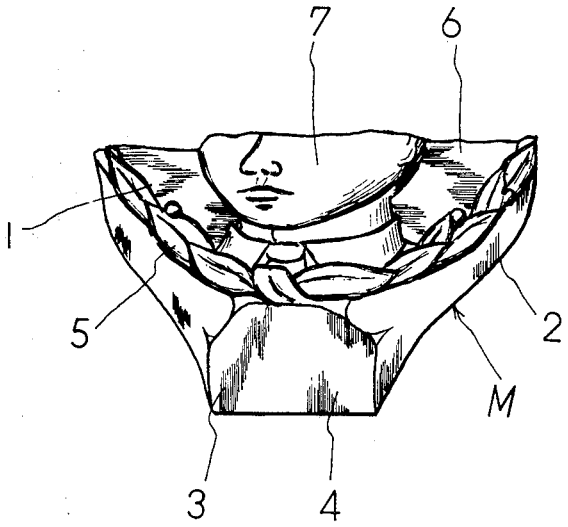
FIG. 3 is an enlarged perspective view of an essential portion showing a seat portion provided at the bottom surface of the medallion.
Figure 2:
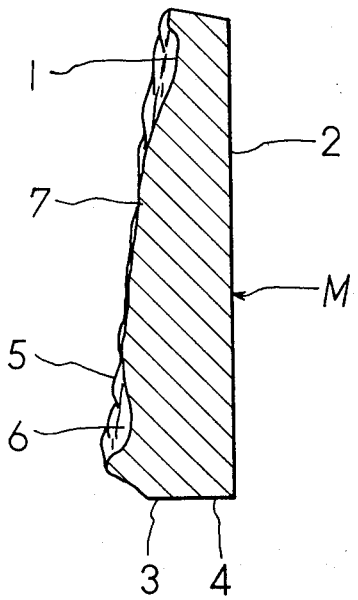
FIG. 2 is a vertical cross-sectional side view of the medallion.

Namely, as shown in FIG. 2, the medallion proper M is so formed that wall thickness is gradually heavier from the top part toward the bottom part. The bottom surface portion of the lower end of the medallion M is provided with a seat portion 4 whose center portion is of horizontal surface as shown in FIGS. 2 and 3. The seat portion 4 having the horizontal surface is almost in right angles to the perpendicular surface of the back surface portion 2, and it has a width of about 30–40% of the maximum width of the front surface portion, of the medallion M.

Figure 1:
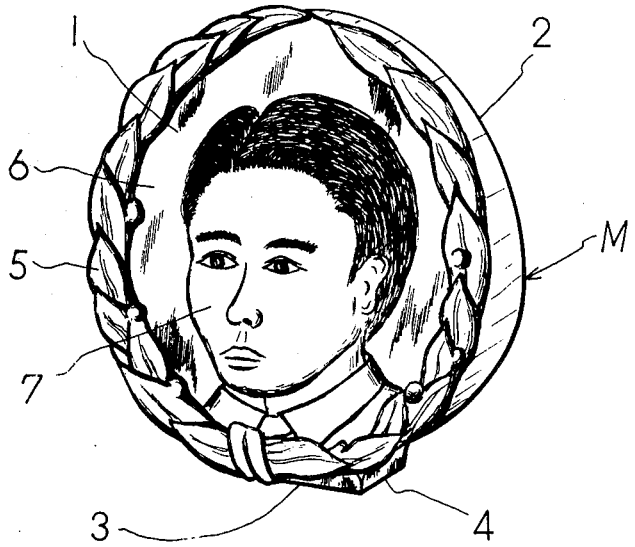
FIG. 1 is a perspective view of a medallion.

The mirror surface portion 1 is so formed as shown in FIG. 1 that the peripheral edge portion is integrally formed by a wreath type decoration portion 5 such as olive leaves, etc. in projected mode, and a space 6 surrounded by the decoration portion 5 is so formed that its surface level is in flush with the level of the decoration portion 5 or is slightly lower level than that of the decoration portion 5, and this surrounded space 6 is formed in slightly inclined surface. The mirror surface portion 1 is formed by embossing an optional pattern 7 such as the face image or bust image of a human being, etc. on the space surrounded by a decoration portion 5.

The decoration portion 5 is designed to increase sense of profoundness of the medallion by providing fruit or olive leaves.

Figure 4:
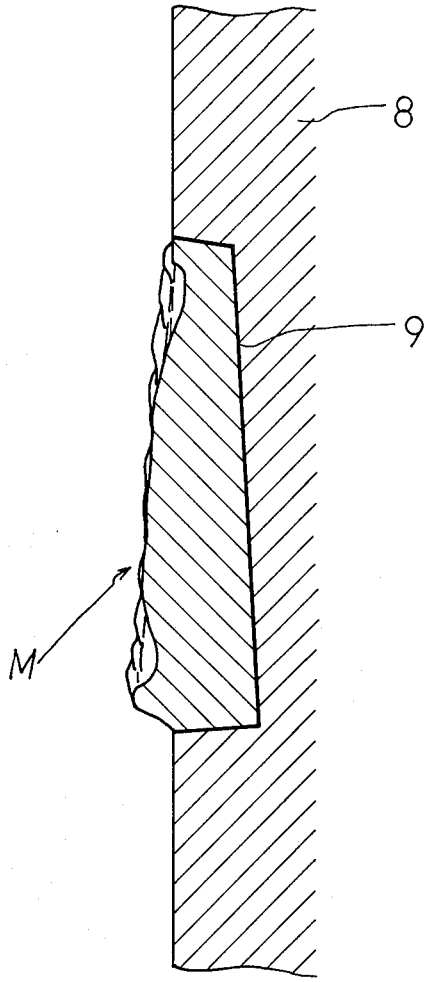
FIG. 4 is a vertical cross-sectional view showing the condition where the medallion is installed on the tombstone.

Furthermore, as shown in FIG. 4, a depressed portion 9 is formed at a proper location on the surface of a tombstone 8, and the medallion M can be fitted easily into the depressed portion 9.

Accordingly, the state of utilization of a conventional medallion is such that it is placed in a depressed portion of a vanity case so as to be viewed in the lid removed condition or the medallion is punched with a hole at a top portion and a metal chain or cord is engaged or the medallion is enclosed by a clamp metal fixture to be put up on a wall surface so that it can be viewed in suspended condition. On the contrary, the medallion M according to the present invention is so formed that a horizontal surface seat portion is formed in the center of the bottom surface portion, and since the mirror surface portion corresponding to the front surface is formed in a slightly inclined surface, and an optional pattern such as a face image or bust image of a human being is embossed in the curved space surrounded by a wreath type decoration portion integrally formed on its periphery in projected mode. The medallion alone can be directly placed on the desk top or the display shelves without adding a separate member such as the front surface vanity case, chain member, and as a result, the medallion can be appreciated as an ornament therefore, the property management can be greatly improved. The face images of ancestors can be used, causing the descendants to recognize the proper value and importance of the family line since the descendants. The medallion can be retained as the ornament before one's death is fitted and after death fixed to the depressed portion formed in a proper portion of the surface of a tombstone. The medallion can thus enhance the spirit of love and admiration of the dead person by the descendants who never saw the deceased by viewing the portrait on the medallion whenever they make a visit to the grave and can better understand the deceased.

I claim:

1. A medallion comprising in combination:

(a) a back surface portion, (b) a front surface portion located forwardly of the back surface portion, said front surface portion comprising:

(1) an integral, forwardly extending, olive leaf wreath-like decoration around the front surface portion periphery.

(2) a pattern of a face or bust of a human being embossed within the space surrounded by said olive leaf wreath-like decoration, and (3) a mirror surface portion extending between the olive wreath-like decoration and the face or bust of a human being, (c) a bottom surface extending between the front and back surface portions and extending perpendicularly to the back surface portion, said bottom surface portion has a horizontal seat portion having a width of 30 to 40 percent of the maximum width of the front surface portion, and (d) the front surface portion is inclined toward the back surface portion, the maximum thickness being at the bottom surface portion.

* * * * *